US007293517B2

(12) United States Patent
Luedtke et al.

(10) Patent No.: US 7,293,517 B2
(45) Date of Patent: Nov. 13, 2007

(54) METHOD AND APPARATUS FOR COMPACTING SAIL CARS

(75) Inventors: Matthew Luedtke, Oak Creek, WI (US); Dane Blackburn, Waukesha, WI (US); Michael Piontek, Chicago, IL (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 11/346,523

(22) Filed: Feb. 2, 2006

(65) Prior Publication Data

US 2006/0185570 A1 Aug. 24, 2006

Related U.S. Application Data

(63) Continuation-in-part of application No. 10/798,927, filed on Mar. 12, 2004, now abandoned.

(60) Provisional application No. 60/735,425, filed on Nov. 10, 2005, provisional application No. 60/468,501, filed on May 7, 2003.

(51) Int. Cl.
*B63H 9/10* (2006.01)

(52) U.S. Cl. ..... 114/102.15; 114/112; 114/204

(58) Field of Classification Search ..... 114/112, 114/204, 102.15, 102, 90, 104, 105
See application file for complete search history.

(56) References Cited

U.S. PATENT DOCUMENTS

| | | | | |
|---|---|---|---|---|
| 701,571 | A * | 6/1902 | Keegan | 114/111 |
| 1,798,772 | A * | 3/1931 | Wood | 114/112 |
| 5,562,063 | A * | 10/1996 | Graham | 114/105 |
| 2004/0221786 | A1 * | 11/2004 | Luedtke et al. | 114/105 |

* cited by examiner

*Primary Examiner*—Sherman Basinger
(74) *Attorney, Agent, or Firm*—Pyle & Piontek, LLC

(57) ABSTRACT

The invention relates to method and apparatus for compactly stacking a sail having a tack, clew and head, the sail being mounted to batten or sail cars above a boom when the sail is stowed, furled or fully lowered. More specifically, most of the cars are compacted or stacked by diverting cars onto several lower tracks, such that the height of the stacked cars is approximately halved. Cars adjacent the boom and tack of the sail may be slidably mounted on at least two of the lower tracks, and carrying the sail between the at least two of the lower tracks. If more than two lower storage tracks are used, the height reduction of the stacked cars can be greater.

54 Claims, 18 Drawing Sheets

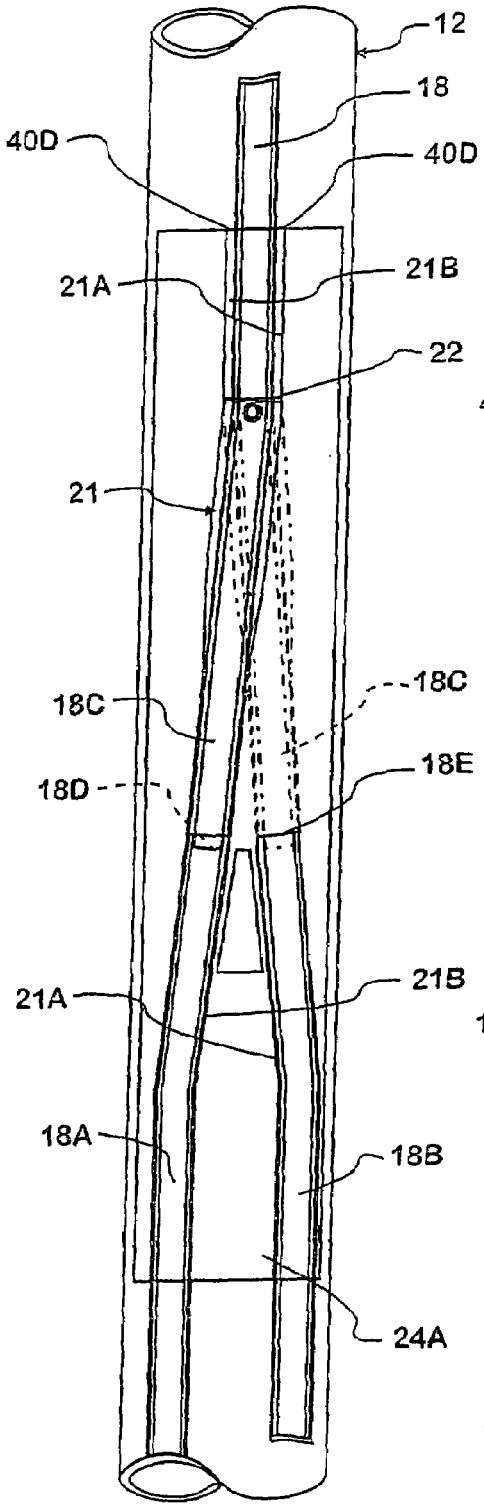
FIG. 10
FIG. 11
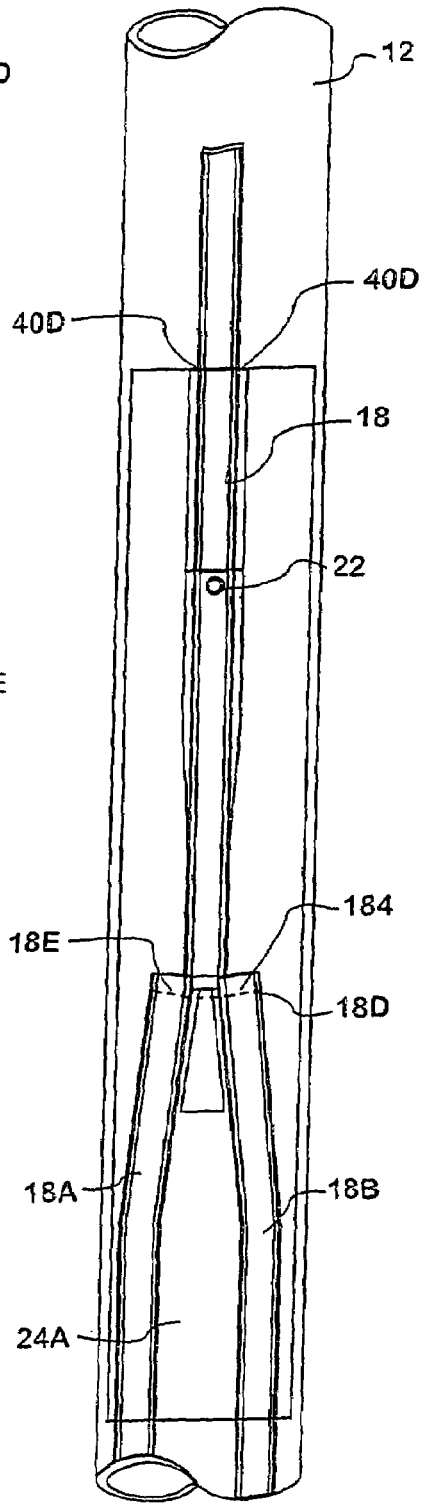

FIG. 13A
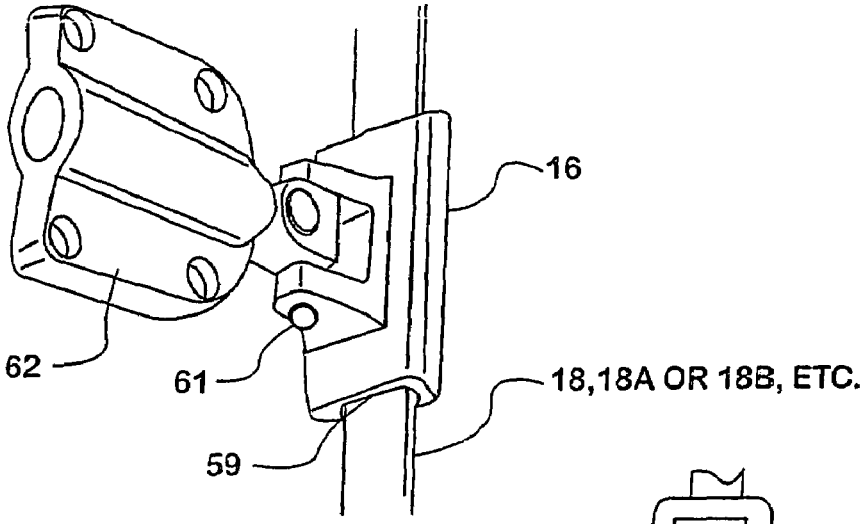
FIG. 13C
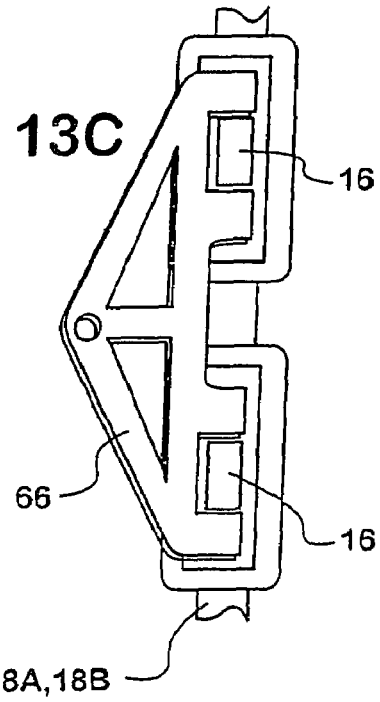
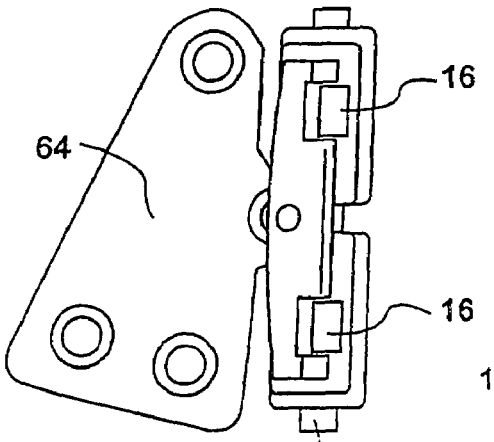
FIG. 13B

FIG. 24B
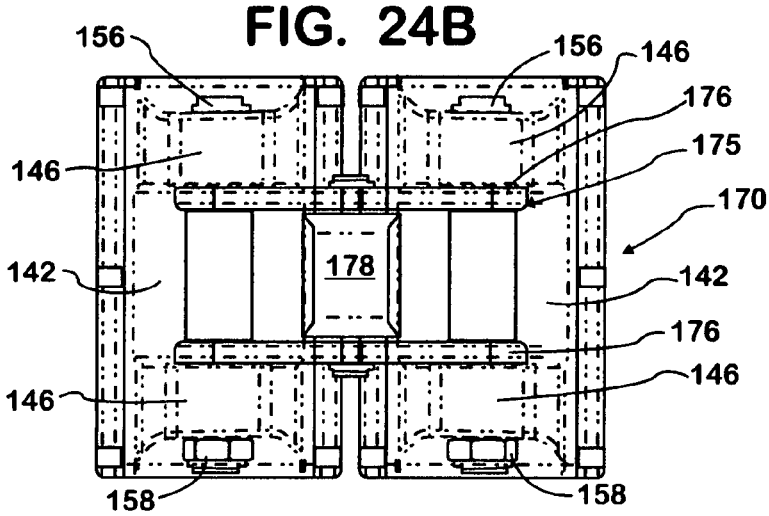
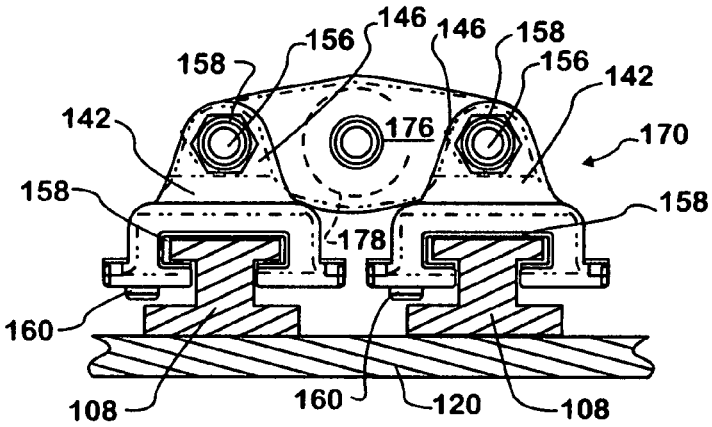
FIG. 24
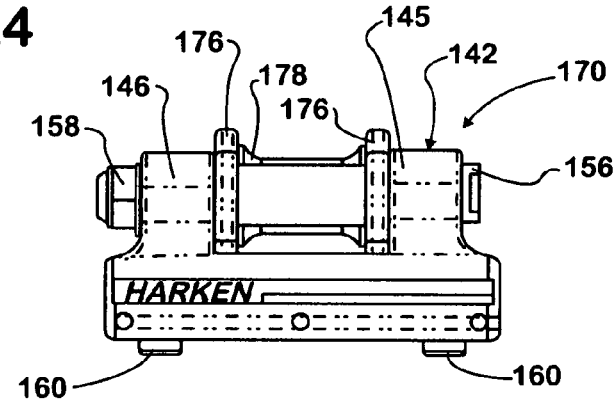
FIG. 24A

METHOD AND APPARATUS FOR COMPACTING SAIL CARS

CROSS REFERENCE

This application is a continuation-in-part of U.S. Non-Provisional Application Ser. No. 10/798,927, filed Mar. 12, 2004, now abandoned which claims priority of U.S. Provisional Application No. 60/468,501, filed May 7, 2003, and the present application and invention also claim the priority of U.S. Provisional Application No. 60/735,425, filed Nov. 10, 2005.

FIELD OF THE INVENTION

The invention relates to method and apparatus for compacting or stacking sail cars above a boom when a very tall sail is lowered or furled. More specifically, most of the cars are compacted by diverting alternating cars onto a split track, to port or starboard, such that the height of the stacked cars is approximately halved.

PRIOR ART

Heretofore, when a sail of a sailboat has been stowed, furled or fully lowered, the sail or batten cars connecting the sail to the mast have been singly stacked along a centerline of the mast. This is not suitable when a sail is of great height, such as approximately 250 feet, is used since the singly stacked cars would reach approximately 20 feet above the boom, making storage of the dropped sail cumbersome at best.

Thus there exists a need for a method and apparatus for compacting the height of the cars which the present invention addresses.

SUMMARY OF THE INVENTION

According to the invention, there is provided an apparatus for compacting sail cars comprising a track along which cars of the sail ride, the track comprising a vertical upper section and a lower section including a port and a starboard track; each car or track having guide structure thereon for, preferably but not necessarily alternately, guiding adjacent cars to opposite tracks of the lower section, effectively halving the vertical height of the stacked cars when the sail is stowed. Further a improved tack car is also disclosed.

Further, according to the invention there is provided a method for compacting sail cars to effectively half a vertical height of the sail cars when stacked upon stowage of the sail, the method comprising the steps of:

- creating a track for engaging the sail cars, the track having an upper vertical centerline section and a lower section including at least a port and starboard track;
- creating the cars with guide structure thereon for, preferably alternately, guiding adjacent cars to opposite tracks of the lower section; and
- stowing the sail by lowering same along the track until the cars are, preferably alternately, received within the port and starboard tracks, serving as stowage tracks.

It should be understood that a different arrangement than strictly alternately stacking cars could be used and yet fall within the scope of the invention.

Still further according to the invention there is provided an apparatus for compacting sail cars comprising a track along which cars of the sail ride, the track comprising a vertical upper section extending up the mast and a lower section including a port and a starboard track; the cars each having guide structure thereon for preferably alternately guiding adjacent cars to opposite tracks of the lower section, effectively halving the vertical height of the stacked cars when the sail is stowed. The track may also incorporate structure for maintaining one or more bottom cars adjacent the boom of the sail along a centerline of the mast rather than to either side thereof so as to provide sail symmetry. Preferably such improved tack car rides on two or more such sail storage tracks.

BRIEF DESCRIPTION OF THE DRAWINGS

FIG. 10 is an end view of another embodiment of the apparatus and method of the present invention wherein a section of the upper track adjacent the lower track sections is capable of moving or pivoting from side to side to deliver adjacent cars to alternating bottom tracks.

FIG. 11 shows the pivoting track section is a centerline or neutral position thereof.

FIG. 13A shows a first accessory comprising a batten attachment fitting for receiving a batten and engaged to a rail car.

FIG. 13B shows another accessory comprising a headboard for a sail engaged to a rail car.

FIG. 13C shows a further accessory comprising a vertical bridge structure engaged to double rail cars.

FIG. 24 is a top view of two sail cars joined to form a double or sail tack car.

FIG. 24A is a side elevational view of the car shown in FIG. 24.

FIG. 24B is a rear elevational view of the car shown in FIG. 24.

DESCRIPTION OF THE PREFERRED EMBODIMENTS

Figures 1, 2A, 2B:
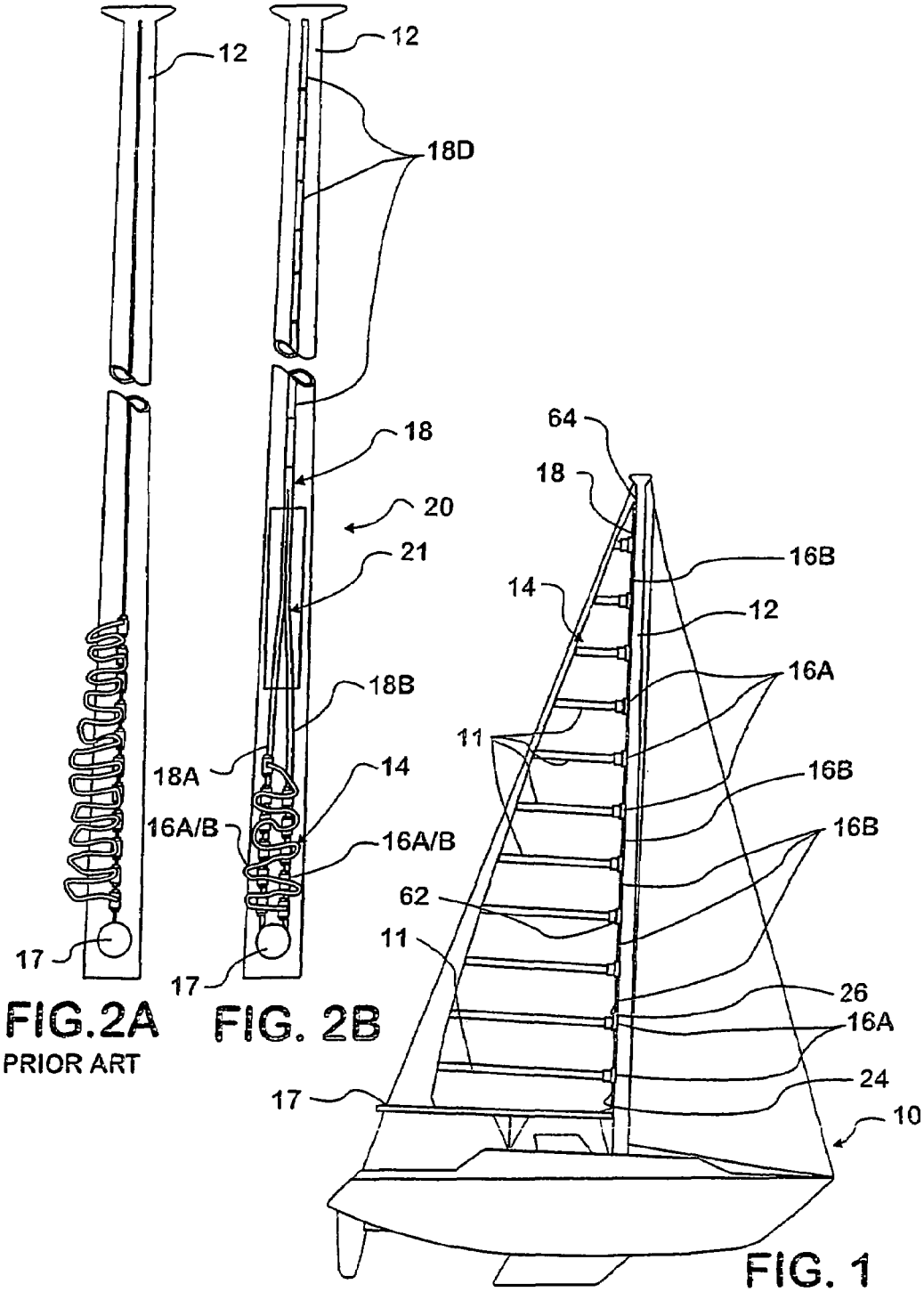
FIG.2A PRIOR ART
FIG. 1 is an elevational view of a sailboat having a very tall mast and sail with battens in the sail, with the battens mounted to batten cars sliding on a mast track.
FIG. 2A is an end view of the prior art method and apparatus presently used for stacking of sail cars when the sail is lowered.
FIG. 2B is an end view of the apparatus and method of the present invention for compact stacking of sail cars.

Referring now to the drawings in greater detail there is illustrated therein a large sailboat 10 having a mast 12 which supports a battened main sail 14, having a plurality of battens 11 and a head, tack and clew (comers).

The sail 14 is held or engaged to the mast 12 by a plurality of cars 16 which can be attached to the battens (batten cars 16A) or the sail (sail cars 16B) which ride up and down the mast 12 along a track 18. The cars sometimes are referred to as "16A/B," meaning it could be either a sail or batten car.

As shown in FIG. 2A, present day methods and apparatus only accommodate vertical stacking of sail cars, as the track is aligned along a vertical centerline of a mast. This is not conducive to efficient storage of a very tall sail, such as one rising on a mast 250 or so feet above a boom 17 and having perhaps twelve batt (batten) cars and another forty sail cars thereon. Such tall sail would produce a vertical elevation of about 20 feet of stacked cars upon lowering of the sail. For that matter, boats with masts on the order of 75 to 80 feet could benefit from the present invention.

Accordingly, the method and apparatus of the present invention address the problem of stacking of the cars to a height approximately half, say 10 feet or less, of that previously obtained.

Turing now to FIG. 2B it will be seen that a novel configuration for the track 18 is proposed which will drop the sail 14 in a novel configuration as shown. As better illustrated in FIGS. 3, 4 and 9-11, the track 18 is a singe track 18 along the greater upper length of the mast. However, along a lower portion of about 10 feet or so, the track 18 is split into port and starboard sections, 18*a* and 18*b*, respectively. As alternating cars 16A or B are guided to either track section 18A or 18B, it will be understood that the excessive height of vertically stacked cars 16A or B will be approximately halved. It should be understood that the track 18, 18A and 18B can be assembled, say, from convenient 6 foot lengths 18D to the desired lengths.

It will be seen that some of the methods and apparatus 20 for producing such alternate stacking are illustrated in FIGS. 3 and 4 and 9-11. In a first embodiment 20A, all track sections 18, 18A and 18B are stationary while in a second embodiment 20B, a small track section 18C adjacent and above the track sections 18A and 18B is movable, and in this instance, pivotable about pivot point 22.

Figure 8:
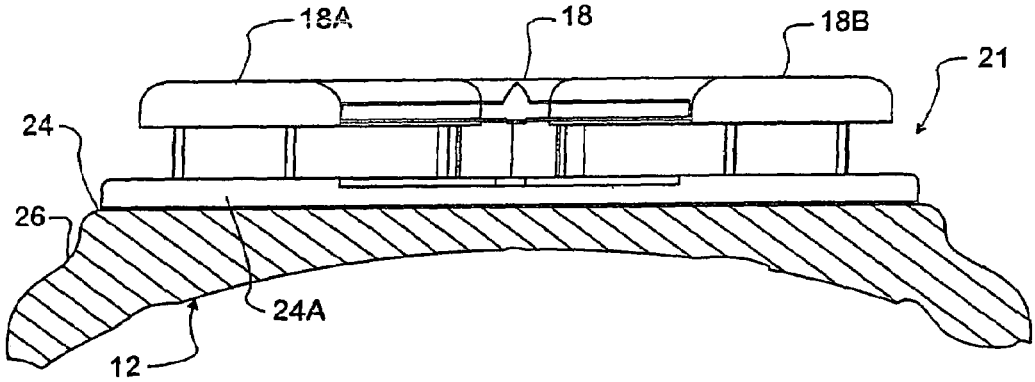
FIG. 8 is a bottom end view of the lower track sections.
Figure 6:
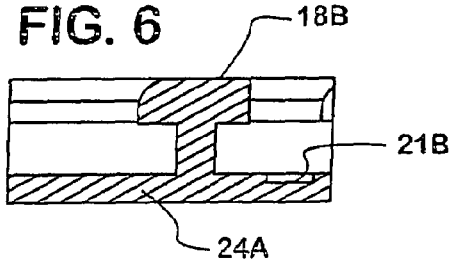
FIG. 6 is a cross sectional view through the area where a bottom tip of the top track section is adjacent to a top tip of a bottom track section and is taken along line 6-6 of FIG. 4.
Figure 5:
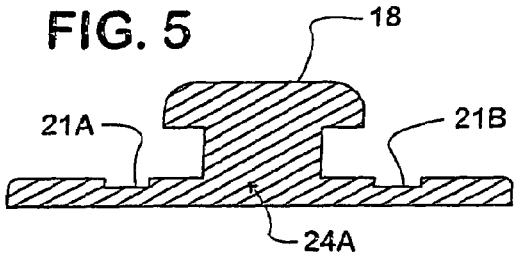
FIG. 5 is a cross sectional view through the upper track section taken along line 5-5 of FIG. 4.
Figure 7:
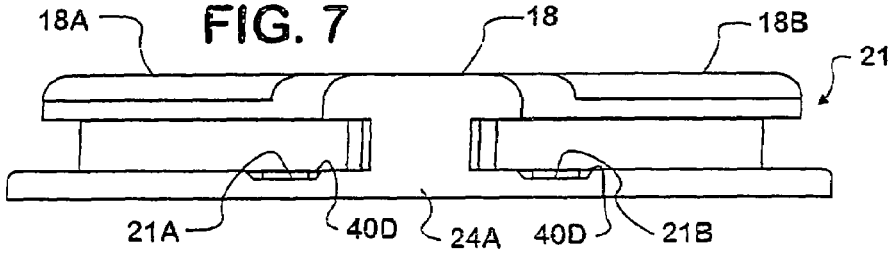
FIG. 7 is a top end view of the upper track section.

Turning now to the first embodiment 20A wherein all track sections are fixed in position, it will first be understood that the mast 12 may be provided with a mounting flat 24 (FIG. 8) along a circumferential or perimeter area 26 (FIG. 8) thereof to which the base 24A (FIG. 8) of apparatus 20 and/or track 18 is mounted.

Figure 3:
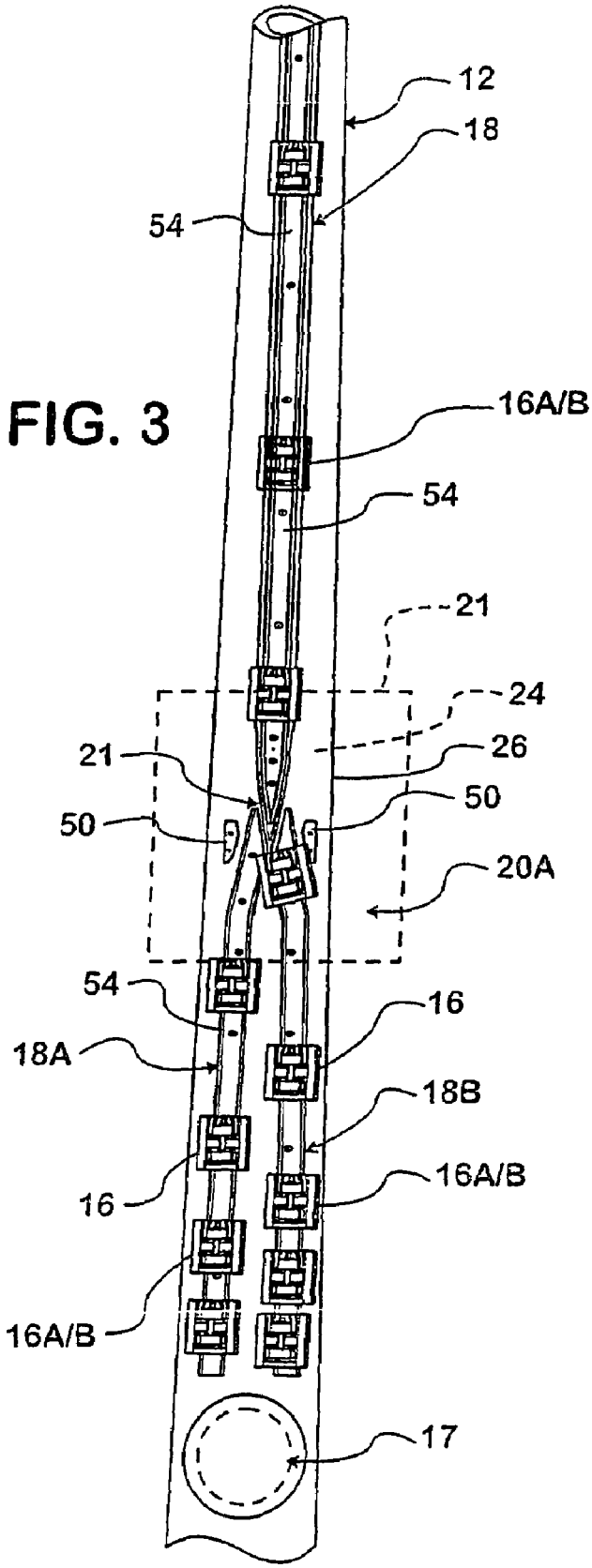
FIG. 3 is an end view of an enlarged of the new apparatus and method for compact stacking of sail cars.
Figure 4:
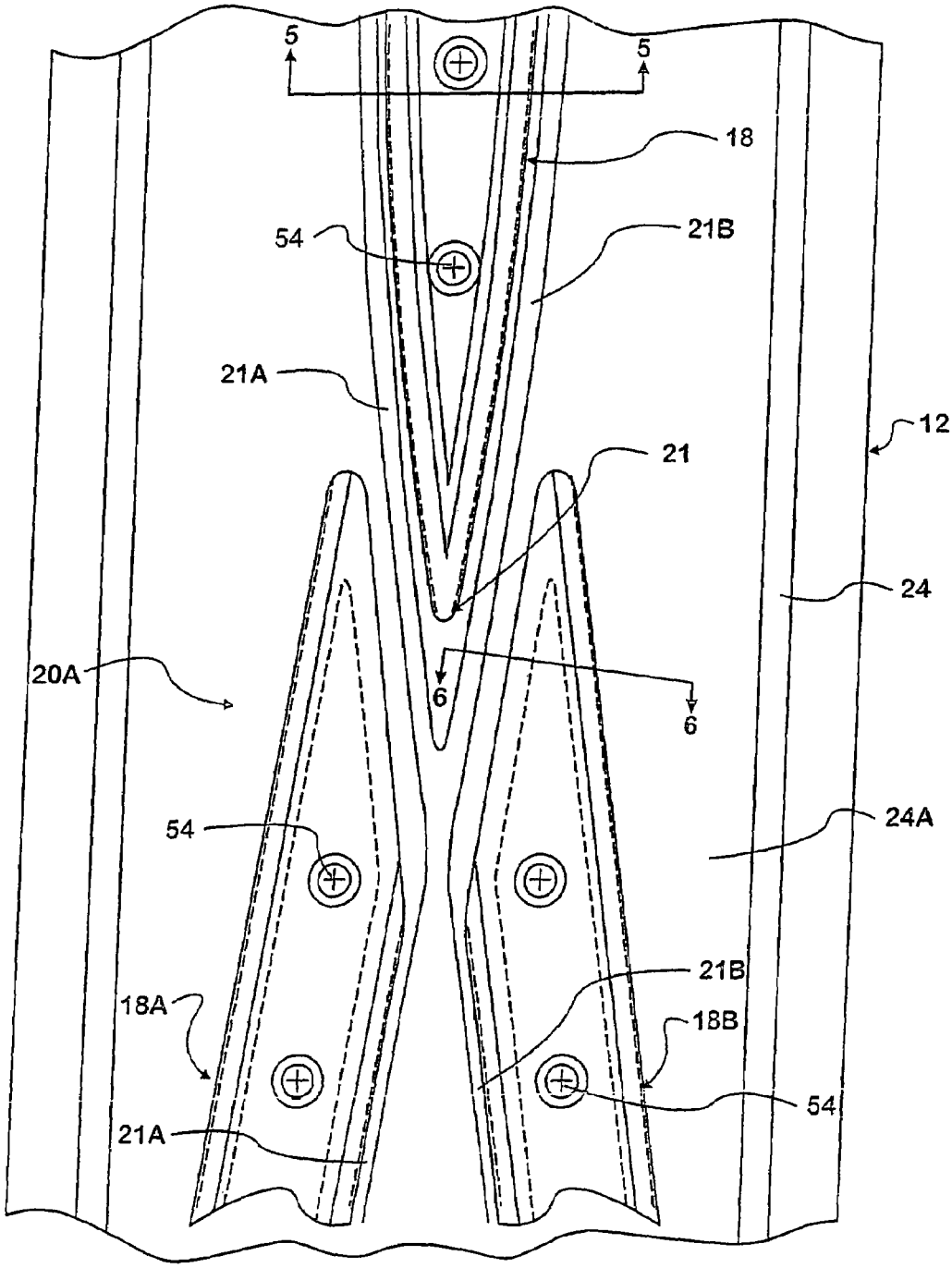
FIG. 4 is an enlarged detail view of the area where the cars are switched onto one or the other of the lower port and starboard track sections.

From FIGS. 3 and 4 further, it will be seen that the bottom track sections 18A and 18B are formed in a "y" or wishbone configuration and have a switch means 21 where alternating cars 16 can follow along the same track section, such as 18A, while adjacent cars 16 (or 16A/B) can follow opposite track sections 18A, 18B, producing two stacks of cars 16 which will approximately half the height of cars stacked vertically. To accomplish this alternative stacking, a switch means or section 21 is provided with port and starboard guide tracks 21A and 21B respectively, which engage respective port or starboard guide pins 40 (see FIGS. 12A, B and C) formed on or provided on the cars 16A/B. One way to achieve this is to use screw ended 40A sort or guide pins means that can be screwed into either the two port or two starboard threaded holes 40P/40S provided in the inner and mast side of the track car. Other means could be provided and achieve such stacking. For example, magnets (with north (N) and south (S) poles) could be arranged on the track (see N, S in FIG. 17) and cars (see N', S' in FIG. 17—primes indicating magnets on the cars) to attract (S', N') or repel (N', S'), alternatively, if desired, the cars to the desired storage tank. Yet another means would be to use cam means for motioning the cars to appropriate track, be it ascending or descending the track sections, be it the upper section on the mast or the lower storage sections on the mast. Where guide pins are used, the upper edge of each of the port and starboard guide tracks 21A and 21B can be provided with entering ramp 40D (FIGS. 10 and 11) to "rerail" the descending guide pins onto upper end of the guide track. Thus, the two lower stacks of cars 16 produce a lower height, a more manageable stowage of the sail 14, decreasing the amount of sail 14 exposed to the elements, such as wind. Also, covering of the sail is eased due to the decreased exposed area.

Also, as will be better described below when the sail cars 16 are defined, it will be understood that no user input is required to produce the desired stacking of the cars 16 when the sail is being lowered and no user input is required when raising the cars 16 to return them to a single file, centerline configuration, above the switch portion of the track.

In this embodiment, also, there are no moving parts required except for the cars 16 moving along the track 18, 18A or 18B, etc., and the guide pins moving in the guide tracks.

It will be understood that with either embodiment 20, the sail 14 when stowed, flakes or folds in a normal manner as shown in FIG. 2B. The sail 14 is pulled to one side or the other of track 18 in FIG. 2B by the car 16 leading the particular following section of sail 14 to its own side, i.e., toward track 18A or 18B, once past switch section 21, which is either fixed as in the first embodiment 20A or is pivotable as in the second embodiment 20B, to be defined further hereinbelow. The embodiments shown in FIGS. 3 to 9 are and operate similar to a "frog" of a railroad switch.

Figure 9:
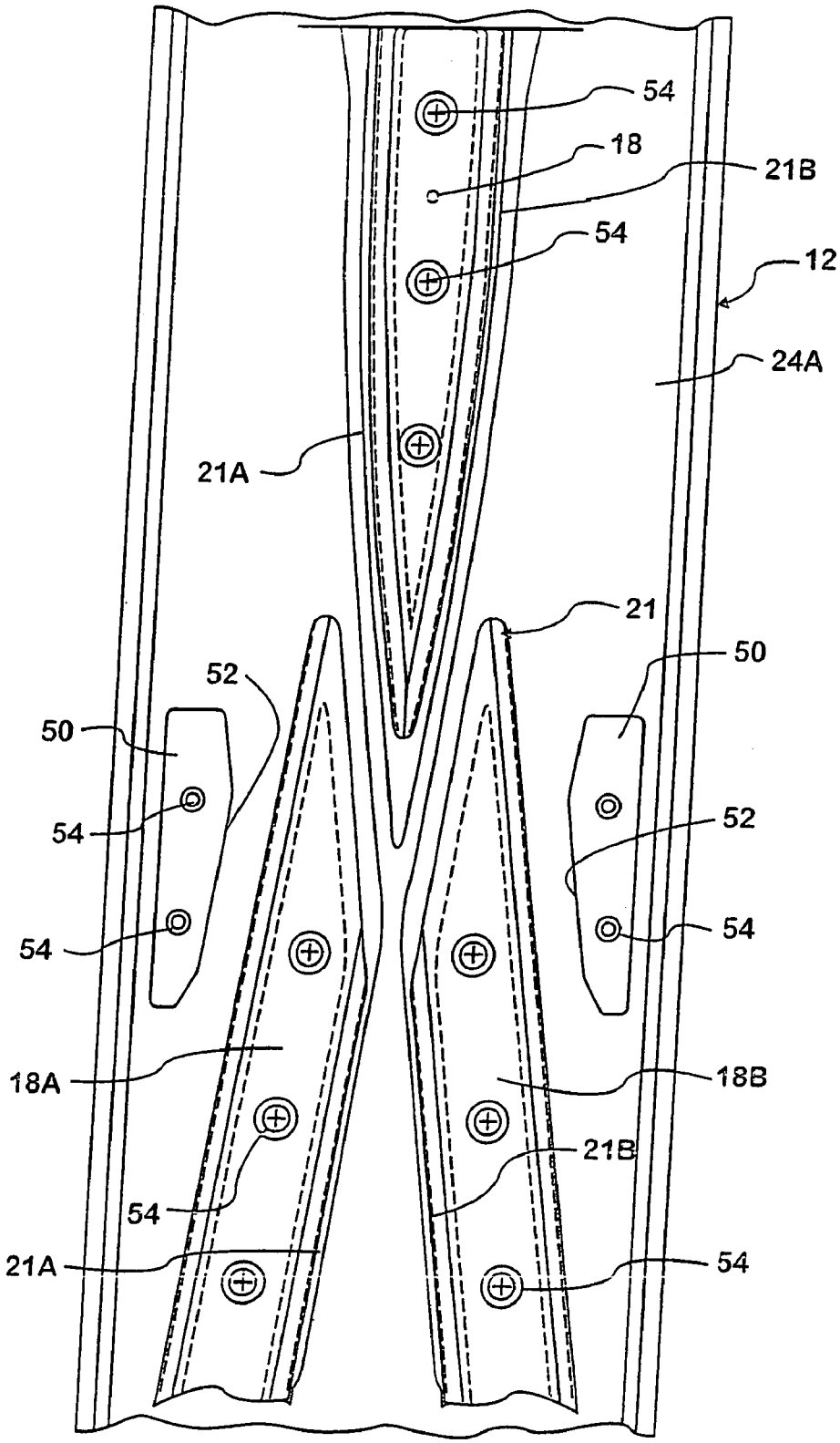
FIG. 9 is an enlarged end view of the lower track sections and shows an optional guide placed to the outside side of each of the lower track sections against which edges of a car body bear with the guides keeping the car body from twisting and becoming lodged in the junction area before completely engaging on the lower track section.

Referring to FIG. 9, an enlargement of the section similar to that of FIG. 3 is shown, and has optional wing guides 50 to help guide by inner car facing surface 52 with the sides of the cars 16 through the switch section 21 of apparatus 20 of the present invention. In other respects, this is similar to the structure shown in FIG. 4. These wing guides 50, like track sections 18, 18A, 18B, etc., can be secured to the base 24A and/or mast 12, by a plurality of fasteners, such as screws or rivets, etc. 54.

Turning now to FIGS. 10 and 11, there is illustrated therein the second embodiment 20B wherein the switch section 21, in the form of a movable portion 18C of the track 18 is pivotable about a pivot point 22 to feed cars 16 to one or the other of bottom or lower track sections 18A and 18B, the switch section 18C having a neutral position as shown in FIG. 11. To help maintain alignment, the lower end 18D of the pivoting sections can slide under the cut-away lip 18E formed on the upper end of the lower sections.

Pivoting of the switch section 18*c* to one side or the other is accomplished through use of cars 16 which include a guide pin 40 thereon cooperating with port and starboard guide tracks, to be described below; with the guide pin 40 and guide tracks also functioning in a similar manner as in the first embodiment 20A.

While the guide pins and guide track will guide descending cars and move the pivot track, upon ascending a different means is used. For ascending a cam mechanism can be used (see FIG. 19). That is, the pivoting track 18C at its lower end is fitted with a cam arm which is engaged by the ascending car's side to move the pivoting track section 18C in alignment to accept the ascending car.

While a pivoting track section is shown that pivots at the top, it would be within the scope of the present invention to provide a pivoting track section that pivots at the bottom thereof. Likewise, a movable track section could have a motion other than pivoting. For example, this movable track could slide so that first one section of storage track was aligned with one upper most section of track, then another section of storage track was aligned with the upper most section of the track, with the cars appropriately ascending or descending the upper track sections to or from the lower storage track sections during raising or furling the sail.

Not only can the sail be furled, it can also be reefed to expose less than its full sail area when sailing. During reefing, the desired number of cars (and sail) are stacked on the storage tracks and then the sail is held down with reefing lines at the reef points in the sail. This same operation also holds the stored (reefed cars) tightly downward.

Figure 12A:
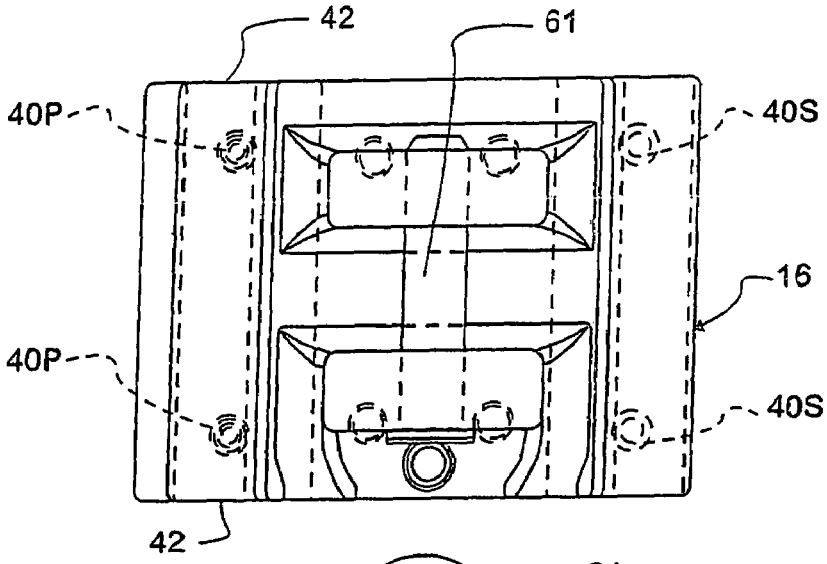
FIG. 12A is an enlarged elevational view showing one embodiment of a sail or batten car for engagement to the track.
Figure 12B:
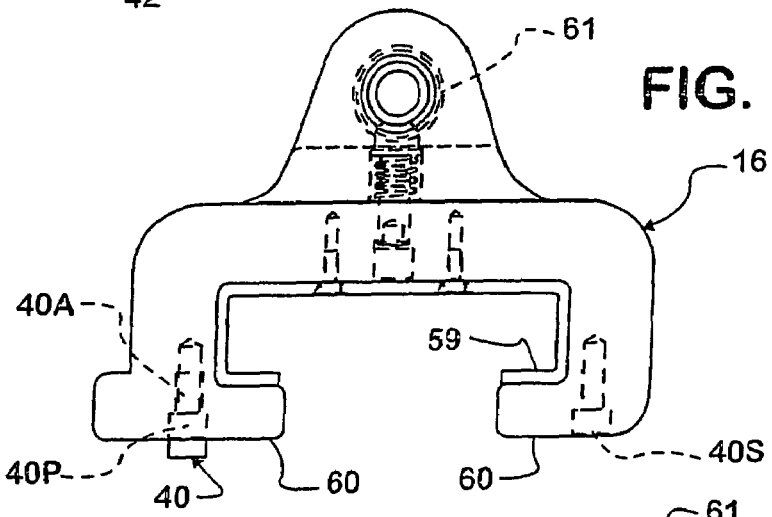
FIG. 12B is a bottom plan view of the sail car of FIG. 12A.
Figure 12C:
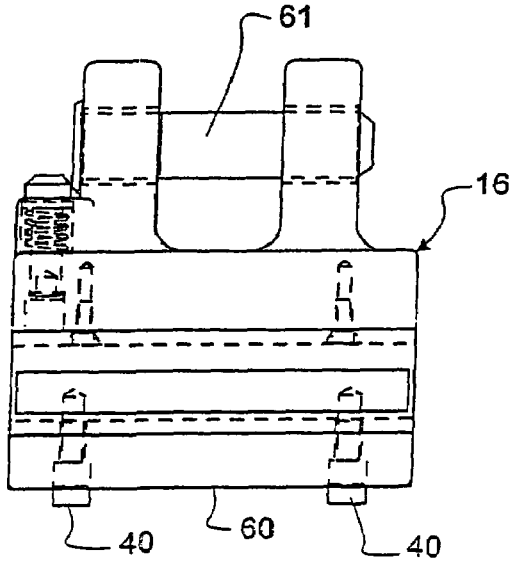
FIG. 12C is a side view of the sail car of FIG. 12A.

Perusing FIGS. 12A and 12B and 12C, the novel configuration of one car 16 used with both the embodiments 20A and 20B, it will be seen that the car has an opening 59 (FIG. 12B) to receive one of tracks 18, 18A, 18B, etc. On car 16 the sorting, sort or guide pin 40 is placed on a leading or forward edge 42 of each car 16 to one side of center. Here, two openings 40S and 40P, preferably threaded, are provided in each the leading and trailing edges 42 within one of which the pin 40 is secured, such as by screw threading as shown best in FIG. 12B. It should be understood that when the sail is raised, the leading and trailing edges 42 are reverse from that when the sail is lowered.

Such pin or pins 40 when placed to the right (relative to FIG. 12B) will engage a starboard groove or guide track 21B in the track section 18, and will be guided onto the starboard track section 18B, having a continuation of the starboard guide track or groove 21B therein.

Alternatively, when the pin or pins 40 is to the left (in FIG. 12B) it engages in a port guide track or groove in track section 18 and is guided into a continuation of the port groove or guide track groove onto port track section 18A. Thus, it will be understood that pins 40 are placed toward opposite sides on adjacent cars 16 to produce right, left, right, left, or port, starboard, port, etc. stowage of the cars on the track sections 18B and 18A, respectively. Preferably, each car has two pins 40, one at or adjacent each of its leading and trailing edges 42.

Turning back to FIGS. 5 through 8, it will be understood that the cars 16 ride along the various track sections in guided position due to engagement of pins 40 within either guide track as provided on an anterior (outside) port or starboard, interior (mast side) face 60 of car 16. The removable pin 61 is provided to receive a sail or batten attachment.

Further, it will be understood from perusal of FIGS. 13A, 13B and 13C that various sail accessories can also be mounted on the cars 16. To this end, each car has the track opening 59 for receiving track 18, 18A, 18B, etc. As examples, a batten attachment 62 is illustrated as engaged to a car 16 in FIG. 13A; a headboard 64 for a sail 14 is illustrated as engaged to a car 16 in FIG. 13B, in this instance: a vertical double car and a bridge structure 66 is illustrated as engaged to double cars 16 in FIG. 13C.

When this system is used with the storage tracks off of the centerline of the mast, there may be some sail nonsymmetry adjacent the boom due to one or two of the cars and adjacent sail luff of the sail being off centerline, but such is not sufficient to seriously effect sail performance and/or efficiency.

If symmetry is essential, such as in a high performance racing sailboat, some additional changes are made. To maintain sail symmetry, the bottom track cars that will be in the raised position but will be below the switch, say two or three cars 16, adjacent the boom 17 may be mounted along a centerline of the mast 12 rather than being fed onto side tracks 18A or 18B so that the sail 14 is symmetrical when filled with air when hoisted and on either a port or starboard track.

Various means can attain this goal, and the illustrative embodiments of FIGS. 14, 15, 16 and 17 are only to be considered as exemplary and not construed as limiting.

Figure 14:
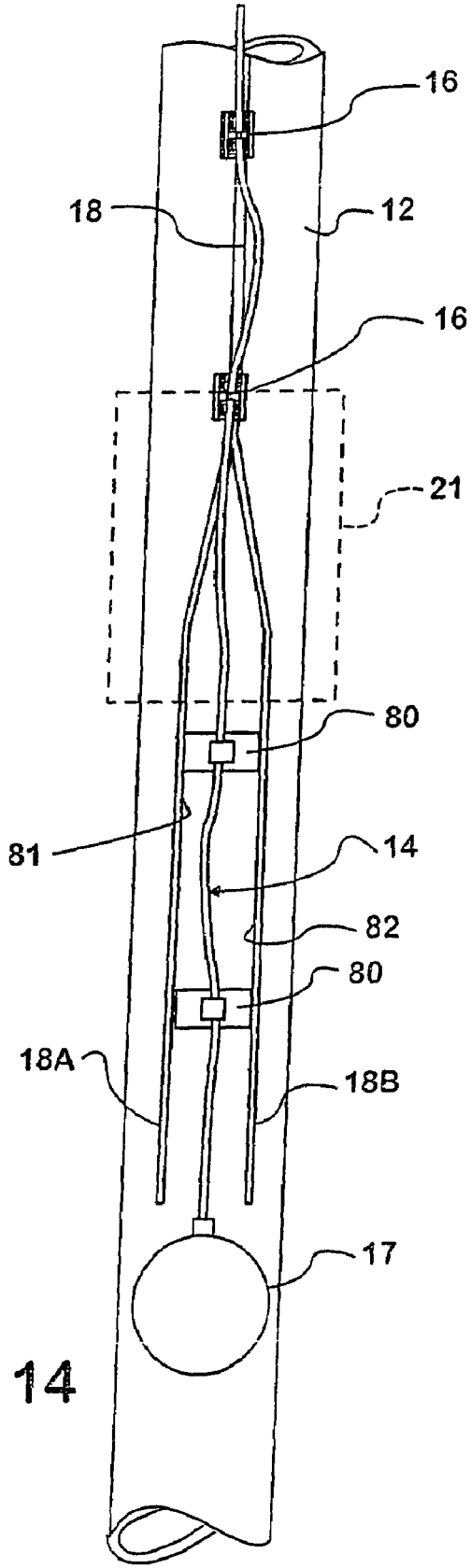
FIG. 14 is an end view showing two bottom cars adjacent the boom riding on their own vertical path by being engaged on the insides of and between the port and starboard tracks.

In FIG. 14, it is proposed to provide a special car 80 which will ride down inner sides 81 and 82 of the tracks 18A and 18B, to be positioned therebetween so the cars 16 carry the sail 14 along the centerline of the mast 12. Alternatively, the car 80 could be constructed to fully engage both sails or tracks 18A and 18B, somewhat in the manner like shown in FIG. 16, that is, have two openings 59 at the necessary spacing of tracks 18A and B.

Figure 15:
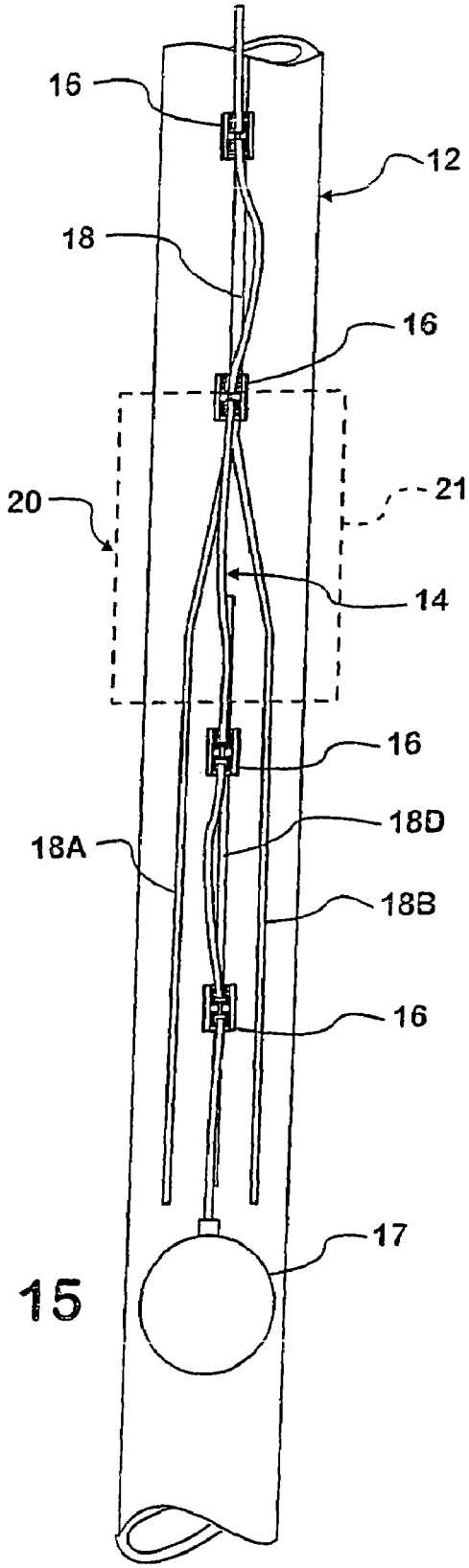
FIG. 15 is an end view showing two bottom cars adjacent the boom riding on their own centerline track between the bottom track sections.

Alternatively, in FIG. 15, a center track 18D may be provided between tracks 18A and 18B onto which the lower cars 16 can be permanently mounted, with higher cars then being guided on the side tracks 18A and 18B.

Figure 16:
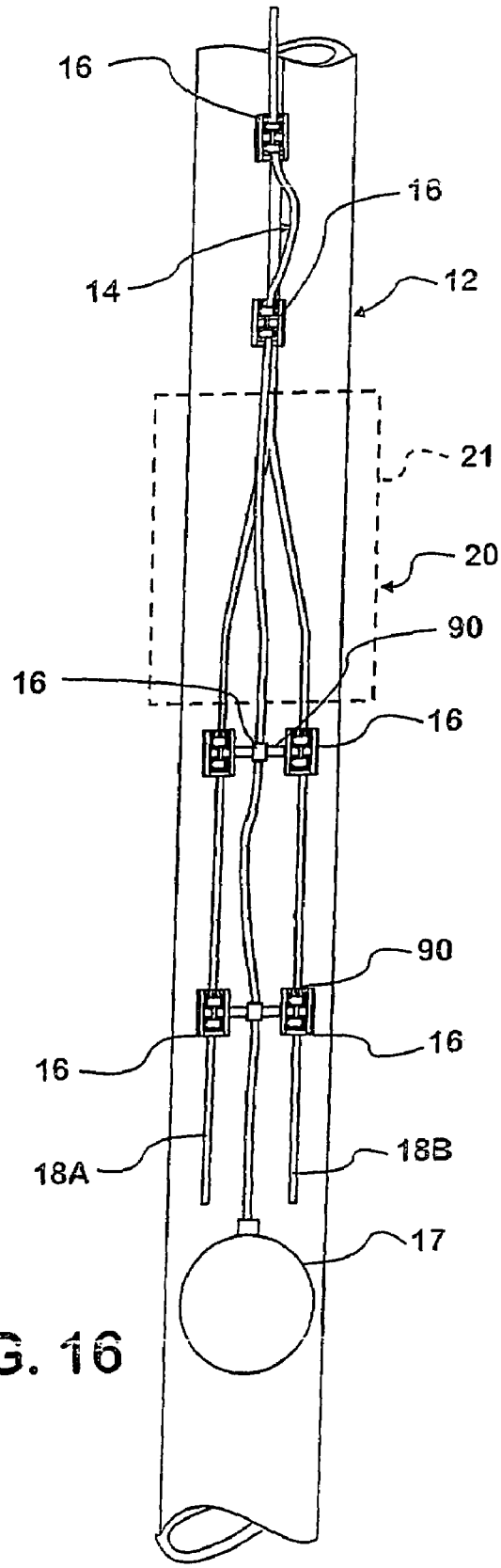
FIG. 16 shows a horizontal bridge formed between the bottom two cars adjacent the boom which are on opposite bottom track sections, the bridge incorporating structure thereon for maintaining the sail in a centerline position between the bottom track sections.

Further, in FIG. 16, a horizontal bridge 90 can be provided between two parallel cars 16 on side tracks 18A and 18B, with the sail 14 engaging the center of the bridge 90, rather than the cars 16 to maintain a centerline position.

Figure 17:
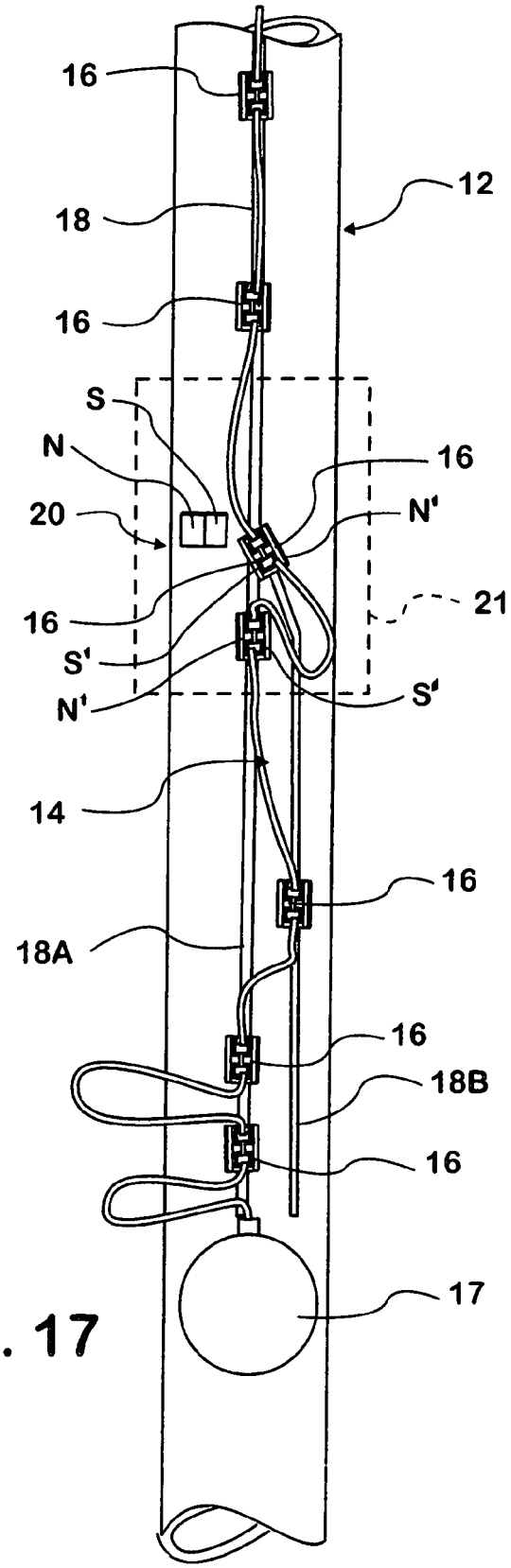
FIG. 17 is yet another alternative having a track with two lower portions, one of which is on the mast centerline, while the other is offset to one of port or starboard; optionally, magnets on the mast and cars can be provided.

Yet another alternative shown in FIG. 17 is to have one or the two lower tracks on the mast centerline, with the other storage track on either side to the port or starboard.

Figure 18:
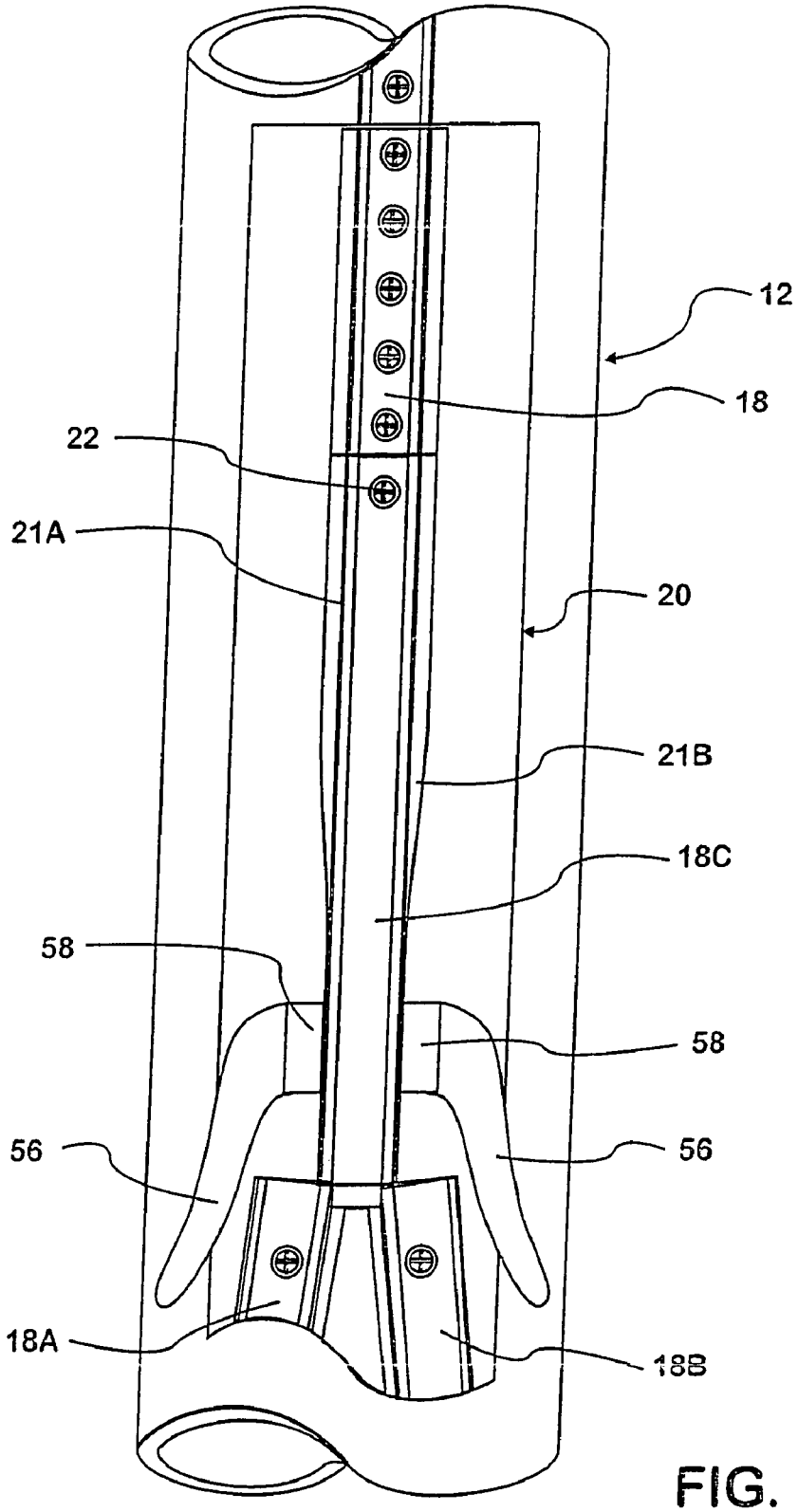
FIG. 18 is a construction used in conjunction with the pivoting track structure of FIG. 10 and shows cam means in the form of a wing on the track to permit the ascending cars to pivot the pivoting track carrying the wing to align the pivoting section to receive the ascending car.

In FIG. 18 is shown cam means for causing ascending cars to cause the upward motion of the car, to pivot the pivotal section of track into alignment to receive the reversing car. To this end, the cam means is in the form of a wing 56 extending from each side of the pivoting track section 18C that can be engaged by the reversing car on either storage track. Each of the wings has appropriate cutouts 58 to permit the car to pass from the lower section 18A or 18B up onto the upper portion of the track on the mast as the sail is raised.

Figure 19:
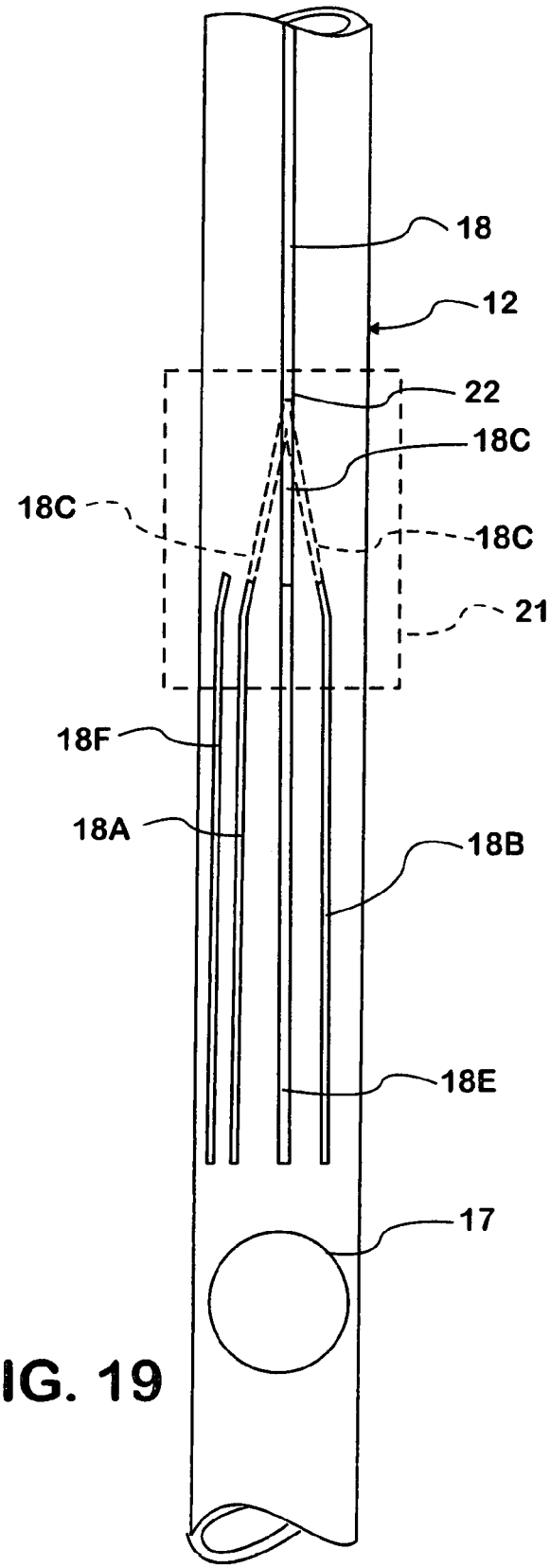
FIG. 19 is a schematic view of another embodiment showing a mast having three storage tracks below a pivoting track section which can pivot to send descending cars to any one of the three tracks; optionally, a fourth track is shown.

In FIG. 19, a version of the present invention is shown which has three storage tracks 18A, 18B and 18E, with track 18E being on the centerline with the upper portion of the track 18. In this version, a pivoting section 18C can be moved or pivoted to engage or align with any of the track sections 18A, 18B and 18E. As shown, track 18A is to port and track 18B as to starboard of the center storage track 18E. This arrangement has the advantage of reducing the height to ⅓ of that without the invention, but yet keep the cars closest to the boom on the centerline of the mast. This arrangement would be useful in a large high performance sailboat.

Figure 20:
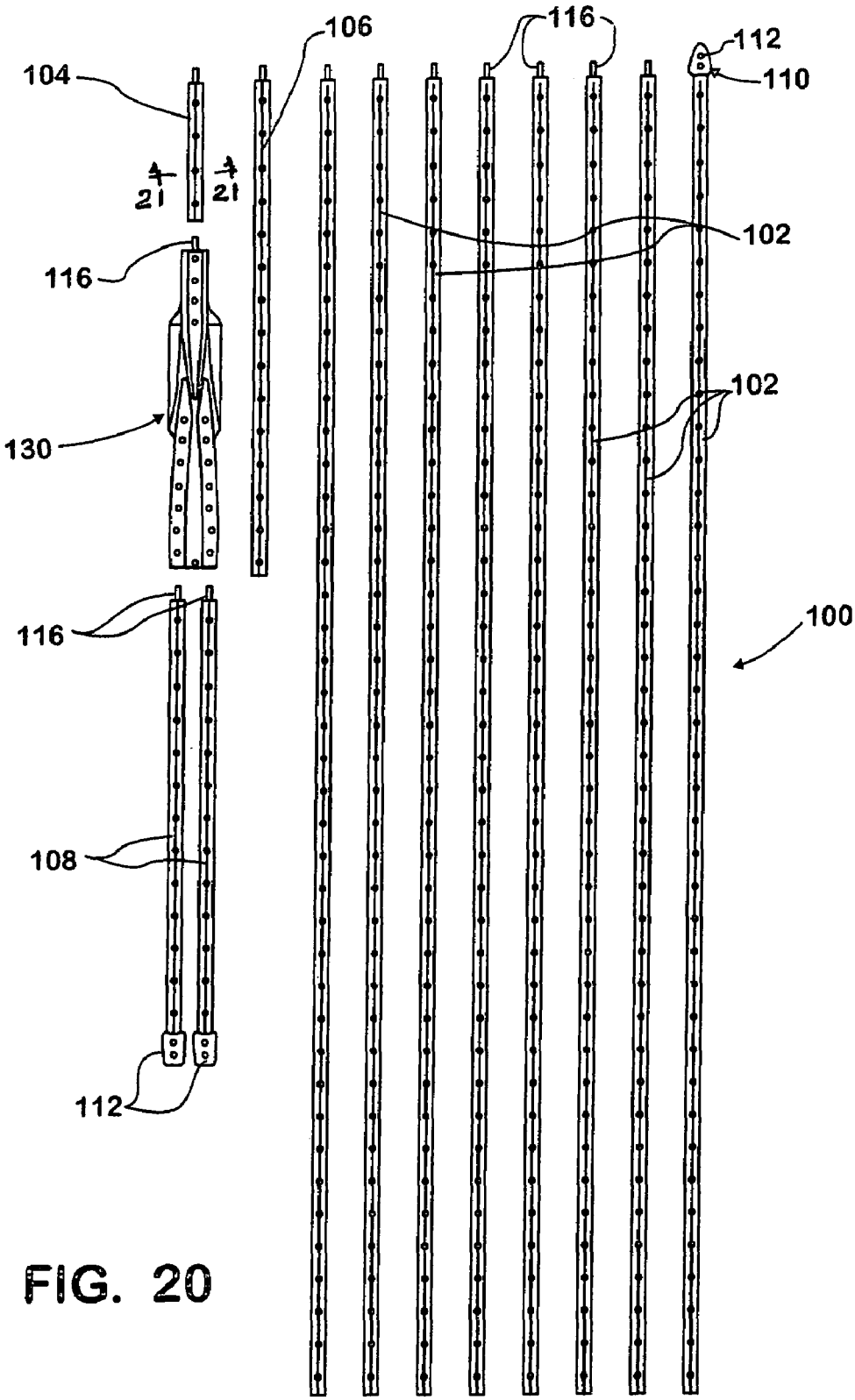
FIG. 20 is a schematic view of a group of tracks and switch means for use with the present invention.

Referring to FIG. 20, a collection 100 of a plurality track rails 102, (say 6 feet in length) gap track rail 104, gate track rail 106 and two storage track rails 108 are shown. The gate track rail 106 contains conventional means (now shown) for setting cars, batten cars or sail cars, onto and off of the track. The track sails 102 extend up the mast from above the boom to essentially its top, indicated at 100. A stop 112, optionally, may be provided at the top, or the tracks 102 arranged to terminate at its top close to the halyard sheeve to prevent an over hoist of the cars off of the track.

Figure 21:
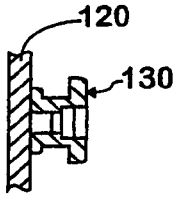
FIG. 21 is a sectional view taken on the line 21-21 of FIG. 20, but shown on the mast.

The bottom ends of the tracks have openings (not shown) to receive alignment pins 116, to align successive sections. The gap track rail 104 is provided should such a short section of track be needed to complete a layout on a mast. As can be appreciated these rails are fastened on otherwise secured to the mast 120 (see FIG. 21).

Figure 22C:
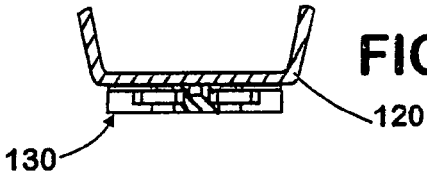
FIG. 22C is a cross sectional end view of the upper track section shown in FIG. 22, but shown on the mast.
Figure 22:
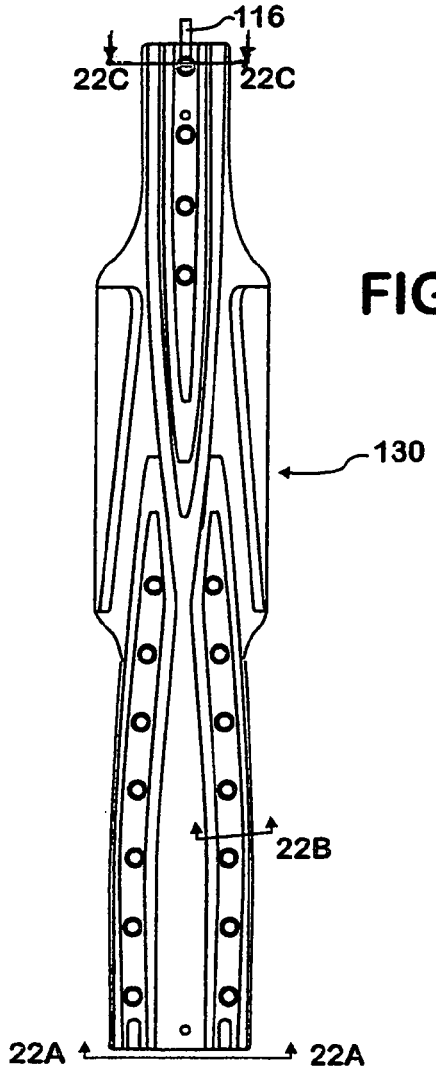
FIG. 22 is an enlarged detailed view of the switch means where the cars are switched from the single upper vertical track to one or the other of the lower storage tracks.

FIGS. 20 and 22 show the switch means 130 which has the alignment pin at the top for the single upper section rail and cooperating alignment openings (not shown) at the bottom to receive the alignment pins 116 of the, in this instance, two storage tracks rail 108. Again stops 112 may be provided at the bottom of the storage tracks 108. If need be additional storage track rails could be provided to extend the length and car capacity of the storage tracks.

Figure 22B:
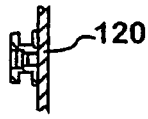
FIG. 22B is a cross sectional view of one of the lower tracks shown in FIG. 22, but shown on the mast.
Figure 22A:
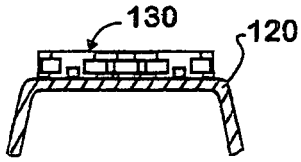
FIG. 22A is an end view of the lower track section shown in FIG. 22, but shown on the mast.

FIGS. 22A, 22B and 22C show how the switch means 130 can be mounted to the mast 120. It should be understood that the track 102, 104, 108 or switch means 130 can be secured to the mast 120 by any fastener means, such as screws, bolts, and even welding or integrally formed or machined there in or on.

Figure 23:
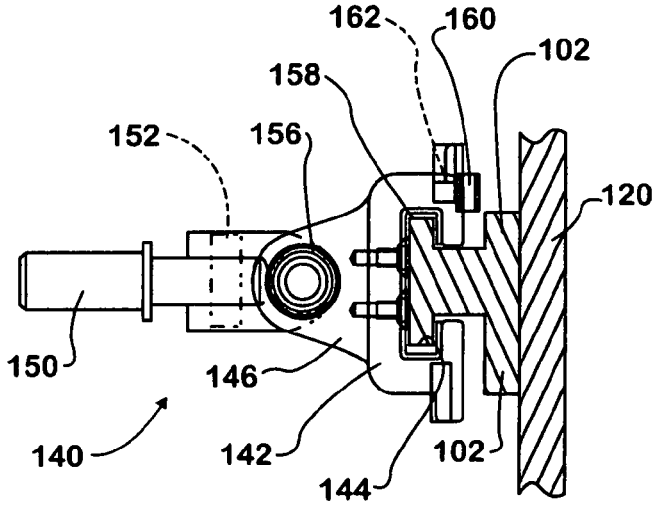
FIG. 23 is a plan view of a sail car for carrying a batten (not shown) for the sail (not shown).
Figure 23A:
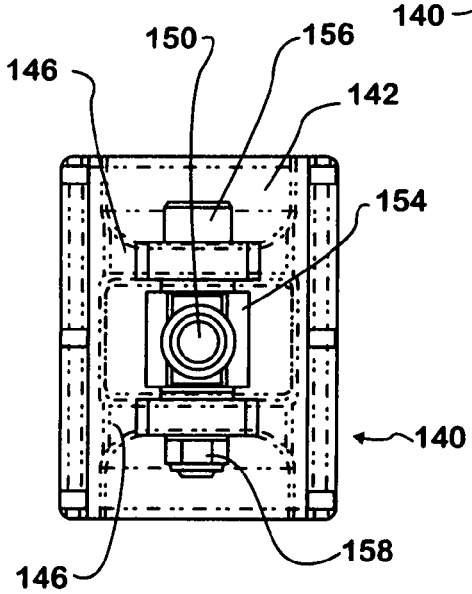
FIG. 23A is a rear elevational view of sail car shown in FIG. 23.
Figure 23B:
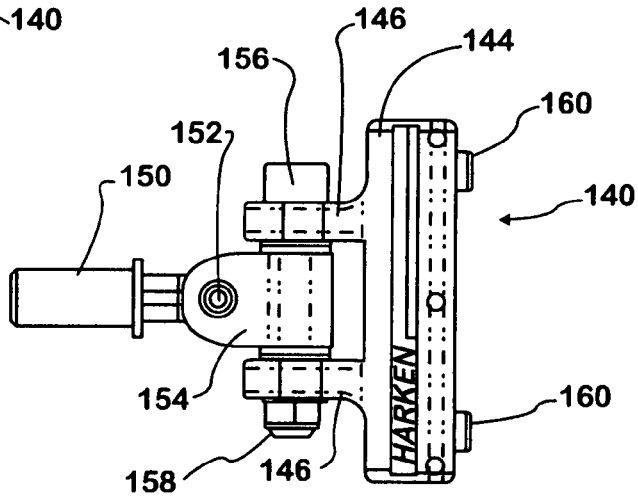
FIG. 23B is a side elevation of sail car of FIG. 23.

A batten car 140 is shown in FIG. 23, and it can ride on track 102, 106, 108 and pass through the switch means 130 or be sorted on to one of the storage tracks 108. As shown in FIG. 23 the batten car has a body 142 which has a recess 144 to closely receive the track rail, in this instance, rail 102 is shown. The body 142 has two extending bolsters 146 which mount a doubly pivoting pin 150 which can carry a swivelable batten (not shown). The pin 150 can pivot about the pin 152 mounted to the sub body 154. The sub body 154, in turn can pivot on the bolt 156, the bolt being held in place in openings in the bolsters 146 by a nut 158. For ease of operation, the recess 144 can be fitted with an internal slider bearing surface 158. The necessary sorting or guide pins 160 can be appropriately installed to sort the car to the port or starboard, as desired. The guide pins 160 fit into threaded opening 162 in the body 142. As apparent, the body can be flipped over to provide appropriate openings 162 on the desired port or starboard side.

Referring to FIGS. 24, 24A and 24B, a double car or tack car 170 is shown in FIG. 24 installed on two storage tracks 108 mounted on the mast 120. It should be understood that these tack cars stay in the double track and mount the sail, whether with or without a batten in the locations below the switch means 130 and the boom of the sail boat.

Preferably, the car 170 is formed with two identical bodies 142. Through not used, as they never leave the double sail storage tracks, the sorting pins 160 are shown but they are non functional. Note these pins 160 could be omitted or removed. Being made from bodies 142 they have similar recesses 144 and slider bearings 158 as the car shown in FIG. 23. A central member 174 is mounted to the two bodies 142. This central member 175 has a pair of spaced apart plates or webs 176 with openings there in to receive the two bolts 156. The two bolts 156 secure the central member's two webs 176 with nuts 158. The central member also includes a center spacer 178 between the webs 176 with an opening there in to which can be secured the sail or batten for use with and to secure the luff of the sail.

While two and three storage track switch arrangements have been shown even four or more could be used(such as the fourth track 18F in FIG. 19).

The three track arrangement has the advantage of further reducing the stack height from over 20 feet for a single track, to 10 feet with a double track, to less than 7 feet with a triple track, to about five feet with quadruple track (18A, 18B, 18E and 18F in FIG. 19) arrangement. While the invention has been described for a sailboat with a mast of about 250 feet tall, it is also useful with smaller boats, say where the mast height is 60 feet or greater and would reduce stacked height of the furled main or other sail. This invention would enable shorter persons to more easily reach the headboard and halyard of a lowered sail. While the invention has been disclosed in connection with a main sail, it could be used for other type sails.

As described above, the method and apparatus of the present invention provide a number of advantages, some of which have been described above and other of which are inherent in the invention. Also modifications may be proposed to the teachings herein without departing from the scope of the invention.

What is claimed is:

1. An apparatus for stacking cars carrying the sail of a sail boat, comprising a track along which said cars ride, the track comprising a first, generally straight, vertical upper section having one track rail, said first vertical upper section carrying most of the sail when said sail propels the sailboat and a second lower section including at least a port and a starboard generally straight, vertical storage track rail, said second lower section at least port and starboard storage track rails being below said first section and carrying the sail on said port and starboard tracks storage track rails storing most of said sail when the sail is not propelling the sailboat but is stowed, and guide structure means thereon for guiding cars to opposite tracks rails of the at least port and starboard storage track rails of said lower section, said guide means requiring no user input to produce the stacking of said cars on said at least port and starboard track rails of said lower section when said sail is lowered, said guide means requiring no user input to return the cars to a single file on said first generally straight vertical upper section one track rail, when raising said sail and said cars from said at least port and starboard track rails, of said lower section said cars being stored on said at least port and starboard storage track rails and effectively reducing by about at least one half the vertical height of the stacked cars in their lowest positions when the sail is stowed were the at least port and starboard storage tracks not used.

2. An apparatus as in claim 1, said guide structure means further including switch means between said upper section and lower section for transferring cars from between said upper section and said at least port and starboard track rails of said lower section.

3. An apparatus as in claim 2, wherein said switch means pivots.

4. An apparatus as in claim 3, wherein said switch means pivots at the top.

5. An apparatus as in claim 2, wherein said switch means comprises a "frog" track section.

6. An apparatus as in claim 2, wherein at least some of said cars carry said sail.

7. An apparatus as in claim 2, wherein at least some of said cars carry a batten for a said sail.

8. An apparatus as in claim 2, wherein the lower section has at least three storage track rails.

9. An apparatus as in claim 2, wherein the lower section has at least four storage track rails.

10. An apparatus as in claim 2, for the mast and sail of a Marconi rig.

11. An apparatus as in claim 2, wherein said cars carry means to transfer said cars to one or the other of said port and starboard track rails of said lower section.

12. An apparatus as in claim 1, further including a mast and boom, said upper section extending up said mast to generally its upper end, said lower section's at least port and starboard track rails extending down below from adjacent said upper section to adjacent said boom.

13. An apparatus as in claim 12, further including switch means between said upper section and lower section for transferring cars between said upper section and said at least port and starboard track rails of said lower section.

14. An apparatus as in claim 13, wherein said switch means pivots.

15. An apparatus as in claim 13, wherein said switch means comprises a "frog" track section.

16. An apparatus as in claim 12, wherein another track rail is located between said at least two track rails of said lower sections, and one or more cars adjacent said boom are located on said another track rail.

17. An apparatus as in claim 12, wherein at least one or more cars adjacent said boom ride on and between said port and starboard track rails.

18. An apparatus as in claim 1, wherein at least some said cars carry said sail.

19. An apparatus as in claim 1, wherein at least some of said cars carry battens for said sail.

20. An apparatus as in claim 1, wherein at least one of said cars carries a head board for said sail.

21. An apparatus as in claim 1, wherein at least two of said cars are mounted together by means other than said sail to form a larger car.

22. An apparatus as in claim 1, wherein one of said lower track rails aligns vertically below said upper track rail and said other track rail is offset to the side of the said one lower track rail.

23. The apparatus as in claim 1, wherein cam means are provided to move said cars onto one or the other of said lower storage track rails.

24. The apparatus as in claim 1, for a sail of at least 60 feet in height.

25. The apparatus as in claim 1, for a sail of at least 75 feet in height.

26. The apparatus as in claim 1, for a sail of at least 250 feet in height.

27. The apparatus as in claim 1, wherein the lower section has at least two storage track rails and the height of the stored stacked sail on said at least two storage track rails is about one half of that were the at least two storage track rails lower section not used.

28. The apparatus as in claim 1, wherein the lower section has at least three storage track rails and the height of the stored stacked sail on said at least three storage track rails is about one third of that were the at least three storage track rails lower section not used.

29. The apparatus as in claim 1, wherein the lower section has at least four storage track rails and the height of the stored stacked sail on said at least four storage track rails is about one quarter of that were the at least four storage track rails lower section not used.

30. An apparatus as in claim 1, wherein said guide means comprises pin means for transferring the cars to different lower section storage track rails.

31. An apparatus as in claim 1, wherein the apparatus may be utilized to store or reef the sail.

32. An apparatus as in claim 1, wherein said guide means comprises cam means between the said mast and said cars for transferring said cars to one or the other of said at least port and starboard storage track rails.

33. An apparatus as in claim 1, wherein said guide means comprises magnet means between said mast and said cars for transferring said cars to one or the other of said at least port and starboard storage track rails.

34. A method for stacking sail cars to effectively reduce a vertical height of the sail cars when stacked upon stowage of the sail, the method comprising the steps of:

"creating a track for engaging the sail cars, the track having an upper, generally straight vertical track centerline section and a lower section including at least a port and starboard sail storage tracks below said upper section;

creating guide means for guiding the sail cars from said upper generally straight vertical track centerline section to at least said port and starboard storage tracks of the lower section;

transferring the sail cars between the upper generally straight vertical track centerline section and said lower section including at least a port and starboard sail storage tracks; and stowing most of the sail by lowering same along the upper track section until most of the sail cars are received on said at least port and starboard storage tracks, serving as stowage tracks for the sail when stowed."

35. The method of claim 34, wherein the creating a track step comprises creating a single upper, generally straight vertical track.

36. The method of claim 35, comprising the step of lowering the sail from said single upper, generally straight vertical track into both at least said port and starboard said storage tracks.

37. The method of claim 36, comprising the step of raising the sail from both said at least port and starboard sail storage tracks onto said single upper, generally straight vertical track.

38. The method of claim 37, comprising the step of raising the sail by switching the sail from said at least port and starboard track of said lower section to said track of said upper section.

39. The method of claim 38, comprising the step of providing each of said storage tracks of a length to accommodate only about one half or less of the sail.

40. The method of claim 35, comprising the step of raising the sail from both said at least port and starboard sail storage tracks onto said single upper, generally straight vertical track.

41. The method of claim 34, comprising the step of lowering the sail by switching the sail from said track of said upper section to said at least port and starboard tracks of said lower sections.

42. The method of claim 34, comprising the step of raising the sail by switching the sail from said at least port and starboard track of said lower section to said track of said upper section.

43. The method of claim 34, comprising the step of providing each of said storage tracks of a length to accommodate only about one half or less of the sail.

44. The method of claim 34, comprising the steps of: providing a mast and a boom, mounting said boom on said mast, providing a switch means on said mast for transferring a sail between the lower storage tracks and upper track section, and running said upper track section from said switch means to generally the top of the mast, and running said lower storage tracks from said switch means to adjacent said boom.

45. The method of claim 44, comprising the step of raising the sail by raising it from said at least port and starboard storage tracks onto said upper track, and furling said sail by dropping said sail from said upper track down to said at least port and starboard storage tracks.

46. The method of claim 34, comprising the step of providing more than two storage tracks.

47. The method of claim 34, comprising the step of providing guiding means for guiding the sail between said upper track and both said at least said port and starboard storage tracks.

48. An apparatus for compacting sail cars comprising a mast track along which cars of the sail ride and are carried when the sail is raised, the track comprising a single, generally straight vertical upper section and a lower section, for stowing the sail including generally straight, vertical at least a port and a starboard storage track; the cars and tracks having switch means for alternately switching cars to opposite port and starboard tracks of the lower section, effectively reducing the vertical height of the stacked cars when the sail is stowed, the track also incorporating structure for maintaining at least the bottom cars of the sail along a centerline of the mast rather than to either side thereof.

49. An apparatus as in claim 48, wherein said switch means comprises a movable section for transferring cars between the upper section and lower section's storage track rails.

50. An apparatus as in claim 49, wherein said movable section pivots.

51. An apparatus as in claim 49, wherein said movable section slides.

52. An apparatus for stacking cars carrying the sail of a sailboat, comprising a track along which said cars ride, the track comprising a first, vertical upper section having one track rail and a second lower section including at least a port and a starboard track rails, guide structure means thereon for guiding cars to opposite tracks rails of the lower section, effectively reducing the vertical height of the stacked cars when the sail is stowed, switch means between said upper and lower section for transferring cars from between said upper section and said at least port and starboard track rails of said lower section, wherein said cars carry means to stagger said cars on said port and starboard track rails of said lower section, and said means to stagger includes a guide pin that rides in said track.

53. An apparatus as in claim 52, wherein said car is constructed to place said pin in one position to cause the car to go to the starboard track rail and in a second position to cause the car to go to the port track rail.

54. An apparatus for stacking cars carrying the sail of a sailboat having a boom for the sail, comprising a track along which said cars ride, the track comprising a first, vertical upper section having one track rail and a second lower section including at least a port and a starboard track rails, guide structure means thereon for guiding cars to opposite tracks rails of the lower section, effectively reducing the vertical height of the stacked cars when the sail is stowed, switch means between said upper and lower section for transferring cars from between said upper section and said at least port and starboard track rails of said lower section, wherein one or more cars adjacent said boom are carried by both said port and starboard track rails.

* * * * *